United States Patent [19]

Cormier et al.

[11] Patent Number: 4,615,716

[45] Date of Patent: Oct. 7, 1986

[54] PROCESS FOR PRODUCING ULTRA HIGH PURITY OXYGEN

[75] Inventors: Thomas E. Cormier; Bruce K. Dawson; Keith B. Wilson, all of Allentown, Pa.; Thomas C. Young, Madison, Wis.

[73] Assignee: Air Products and Chemicals, Inc., Allentown, Pa.

[21] Appl. No.: 769,929

[22] Filed: Aug. 27, 1985

[51] Int. Cl.[4] ..... F25J 3/02

[52] U.S. Cl. ..... 62/24; 62/22; 62/27; 62/28

[58] Field of Search ..... 62/11, 22, 24, 27, 28, 62/36, 40

[56] References Cited

U.S. PATENT DOCUMENTS

| | | | |
|---|---|---|---|
| 2,502,282 | 3/1950 | Schlitt | 62/27 |
| 2,530,602 | 11/1950 | Dennis | 62/27 |
| 2,559,132 | 7/1951 | Roberts | 62/27 |
| 2,603,956 | 7/1952 | Borchardt | 62/27 |
| 2,817,216 | 12/1957 | Etienne | 62/123 |
| 3,363,427 | 1/1968 | Blanchard et al. | 62/21 |
| 3,370,435 | 2/1968 | Arregger | 62/28 |
| 3,751,933 | 8/1973 | Balabaev et al. | 62/22 |
| 3,813,890 | 6/1974 | Bligh | 62/28 |
| 3,969,481 | 7/1976 | Murray | 423/219 |
| 4,137,056 | 1/1979 | Golovko | 62/24 |
| 4,433,989 | 2/1984 | Erickson | 62/22 |
| 4,433,990 | 2/1984 | Olszewski | 62/28 |

*Primary Examiner*—Ronald C. Capossela

*Attorney, Agent, or Firm*—Carol A. Nemetz; James C. Simmons; E. Eugene Innis

[57] ABSTRACT

A method of oxygen recycle on the bottom section of the low-pressure column of a dual-pressure column, with an increase in the bottom section reboil vapor rate, allows an appreciable increase in the production rate of ultra high purity oxygen and a substantial decrease in power required as compared to conventional processes.

13 Claims, 1 Drawing Figure

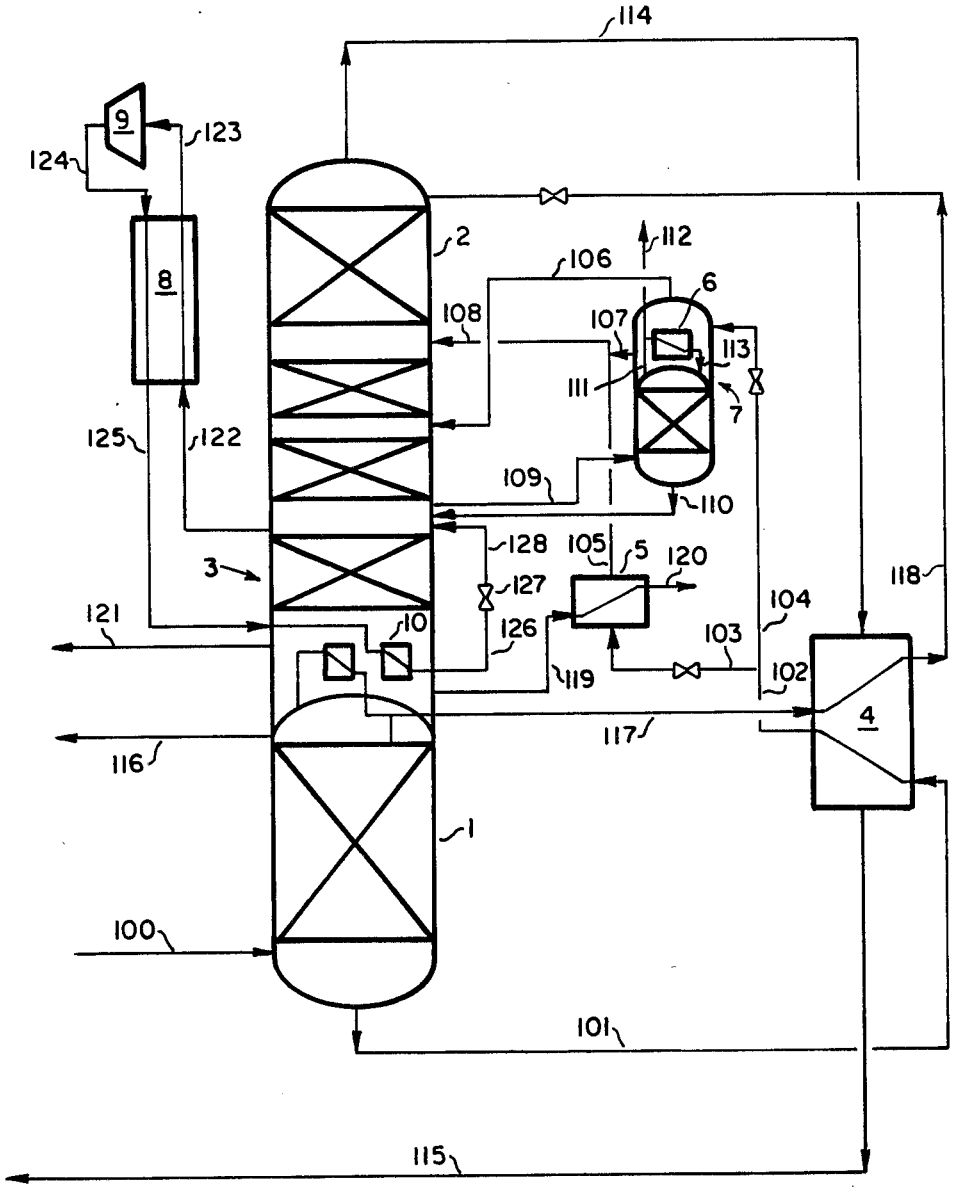
114
9
123
124
8
2
112
106
6
108
107
113
111
7
125
122
109
110
128
105
5
120
118
3
127
104
121
10
126
103
119
102
4
117
116
1
100
101
115

PROCESS FOR PRODUCING ULTRA HIGH PURITY OXYGEN

TECHNICAL FIELD

This invention pertains to the production of ultra high purity oxygen by the liquefaction and fractional distillation of air.

BACKGROUND OF THE INVENTION

In the past the demand for ultra high purity (UHP) oxygen of greater than 99.5% has been sporadic and required only limited quantities. Two principal methods produced ultra high purity oxygen sufficient to meet this demand.

The first method is the operation of a conventional air separation plant at greatly reduced UHP oxygen product recovery rates. The plant can be any one of several designs, such as the classical Linde dual-column configuration for either liquid oxygen (LOX) or gaseous oxygen (GOX). The plant is operated at an increased air feedrate such that the resulting reflux ratios in the low-pressure column yield the required purity utilizing the available tray configuration. One drawback of this method is the high specific power required. Another drawback is that crude argon cannot be economically produced.

The second method is the operation of a plant specifically designed to increase the usual commercial grades of liquid oxygen to the required purity. This plant would normally consist of distillation columns and a heat pump system to operate the columns, with necessary heat exchangers. An example of this method is more fully disclosed in U.S. Pat. No. 3,363,427.

In addition to the two principal methods detailed above, U.S. Pat. No. 3,969,481 describes the electrolysis of water with subsequent drying and purification to produce ultra high purity oxygen.

The rectification of a gas mixture containing at least three components is shown in U.S. Pat. No. 2,817,216 ('216). The process of the '216 patent increases the purity of the lower boiling component, specifically nitrogen, by increasing the yield of the intermediate boiling point component(s), specifically argon, utilizing various recycle streams. In one embodiment, a nitrogen recycle compressor is shown on the high-pressure column. Patentee notes generally that increasing the yield of the intermediate component will also increase the purity of the higher boiling point component.

With the advent of the space age and the related technology that has grown around it, there has been a marked increase in demand for ultra high purity oxygen. One important factor leading to the increased demand has been the use of ultra high purity oxygen in fuel cells.

All of the methods of producing ultra high purity oxygen described above require a high specific power. Power is the prime cost of producing ultra high purity oxygen. In order to reduce the costs of processes that utilize ultra high purity oxygen as a feed stream, the cost of producing ultra high purity oxygen must be reduced.

SUMMARY OF THE INVENTION

The present invention pertains to the production of ultra high purity gaseous oxygen by liquefaction and fractional distillation of air utilizing a dual-column air separation process wherein an oxygen recycle on the bottom section of the low pressure column, with an increase in the reboil vapor rate of that section, allows an appreciable increase in the production rate of ultra high purity oxygen compared to the conventional processes. Recycle of the oxygen stream requires a condensation pressure that is less than half the required pressure for the inlet air, and therefore requires less power than operation in the reduced recovery mode. There is a similar reduction of power when compared to an additional nitrogen recycle system, for example, the '216 recycle. The efficient oxygen recycle of the present invention reduces the power, and therefore the cost, of producing ultra pure oxygen by more than 9% over the power required by the conventional reduced recovery methods. Additionally, crude argon may be economically produced.

BRIEF DESCRIPTION OF THE DRAWINGS

The FIGURE is a schematic flow diagram of conventional dual-column air separation system modified, according to the present invention, by the addition of an oxygen recycle system on the bottom section of the low pressure column.

DETAILED DESCRIPTION OF THE INVENTION

The FIGURE shows an illustrative embodiment of a dual-column air separation system with an argon sidearm column modified by the addition of an oxygen recycle system on the bottom section of the low pressure column of a dual-column system.

Referring to the FIGURE, air previously cleaned of high boiling point impurities and cooled to its liquefaction temperature by any of several known means is passed through conduit 100 to the high-pressure column 1 of dual-column 3, where it is separated into two nitrogen streams 116 and 117, and into rich oxygen stream 101.

Stream 101, after being cooled in heat exchanger 4, exits as stream 102 and is split into streams 103 and 104. Stream 103 is heated in heat exchanger 5 and, exiting as stream 105, combines with stream 107 to form stream 108 and enters low-pressure column 2 of dual-column 3.

Stream 104 enters the auxiliary overhead condenser system 6 of the argon sidearm column 7, where it is heated and splits into the exiting streams 106 and 107. Stream 106 leaves the auxiliary overhead condenser system 6 and enters the low-pressure column 2. Stream 107 leaves the auxiliary overhead condenser system 6, combines with stream 105 to form stream 108, and enters the low-pressure column 2.

Stream 109 is removed from the low-pressure column 2 to feed the argon sidearm column 7. Liquid stream 110 exits from the bottom of argon sidearm column 7 and enters the low-pressure column 2. Argon vapor stream 111 exits from the top of argon sidearm column 7, and is split into an argon product vapor stream 112 and an argon reflux stream 113.

Vapor stream 114 exits from the top of the low-pressure column 2, and is heated in heat exchanger 4 from which it exits as stream 115. Waste gaseous nitrogen stream 115 is warmed to ambient by known means not shown.

Waste vapor stream 116 exits the high-pressure column 1 and is used to provide plant refrigeration by known means not shown. Liquid stream 117 exits the high-pressure column 1 and is cooled in heat exchanger 4. The exiting cooled stream 118 is flashed to lower pressure and enters the low-pressure column 2.

Product liquid oxygen stream 119 exits the low-pressure column 2, is cooled in heat exchanger 5, and exits exchanger 5 as product liquid oxygen stream 120. Product gaseous oxygen stream 121 exits the low-pressure column 2 and is heated by known means not shown.

The above description is an illustrative example of a conventional dual-column air separation system, which system is modified by the present invention as follows.

An oxygen-rich vapor stream 122 is removed at a first intermediate level of the low-pressure column 2. Vapor stream 122, renamed stream 123, is compressed in compressor 9. Exiting compressor 9 as compressed vapor stream 124 and renamed vapor stream 125, it is condensed to a liquid in an auxiliary low-pressure column reboiler. The condensed liquid stream 126 is flashed, for example by means of expansion valve 127, to the pressure of the low-pressure column 2, forming a stream 128 of a gas and liquid mixture. The flashed stream 128 is returned to the low-pressure column 2 at a second intermediate level.

Another embodiment of the present invention is to cool the compressed vapor stream 124 in a heat exchanger, which cooled stream 125 is subsequently condensed.

A preferred method of operation is to remove oxygen-rich vapor stream at a first intermediate level of the low-pressure column 2. Vapor stream 122 is heated to ambient temperature in heat exchanger 8 from which it exits as vapor stream 123. Vapor stream 123 is compressed in compressor 9 and cooled in an associated after-cooler by known methods. Exiting compressor 9 and associated after-cooler as compressed vapor stream 124, it is cooled in heat exchanger 8 against stream 122, exiting as vapor stream 125. Vapor stream 125 is condensed to a liquid in an auxiliary low-pressure column reboiler. The condensed liquid stream 126 is flashed, for example by means of expansion valve 127, to the pressure of the low-pressure column 2, forming a stream 128 of a gas and liquid mixture. The flashed stream 128 is returned to the low-pressure column 2 at a second intermediate level.

In all of the embodiments of the present invention, the second intermediate level is preferably the same tray or higher than the first intermediate level.

A method for condensing stream 125 is to compress stream 123 to such a pressure that it will condense when in indirect heat exchange with boiling oxygen. For example, stream 125 after pre-cooling can be condensed, as illustrated in FIG. 1, in an auxiliary low-pressure column reboiler 10 of dual-column 3 by indirect heat exchange with boiling oxygen.

In the preferred embodiment, stream 123 is compressed to about 32 to 46 psia so that it will condense when in indirect heat exchange with boiling oxygen at about 20 to 27 psia.

The present invention substantially reduces power requirements as compared to conventional processes. The following table is a summary of cycle performance for three cases, each producing 500 tons/day of gaseous oxygen.

SUMMARY OF CYCLE PERFORMANCE

| | Case 1 Base Case | Case 2 Reduced Recovery Cycle | Case 3 Oxygen Recycle |
|---|---|---|---|
| GOX Product Rate | 500 ton/day | 500 ton/day | 500 ton/day |
| GOX Purity (Vol %) | 99.5% | 99.99% | 99.99% |
| GOX Recovery Rate (Vol % of feed air) | 20.5% | 17.0% | 19.9% |
| Main Air Compressor Flow | 6631 lb mol/hr | 7966 lb mol/hr | 6805 lb mol/hr |
| Main Air Compressor Discharge | 102.7 psia | 113.2 psia | 106.4 psia |
| Main Air Compressor Power | 6241 KW | 7870 KW | 6527 KW |
| Auxiliary Compressor Power | — | — | 618 KW |
| Total Power | 6241 KW | 7870 KW | 7145 KW |
| % of Base Case Power | 100.0 | 126.1 | 114.5 |

The first column of the table pertains to a base case which is a dual-column air separation plant producing gaseous oxygen of a 99.5% purity, and at a 20.5% recovery rate. The main air compressor requires 6241 kilowatt (KW).

The second column of the table pertains to the operation of a dual-column air separation plant at a greatly reduced recovery rate of 17.0%. Production of gaseous oxygen of 99.99% purity requires 7870 KW for the main air compressor. This is an increase of 26.1% above the power required for the base case.

Column three of the table, as described by the present invention, pertains to the operation of a dual-column air separation plant modified, as taught by the present invention, by the addition of an oxygen recycle loop on the low-pressure column. Purity of the gaseous oxygen (GOX) product is equivalent to the 99.99% of the reduced recovery case, while the recovery rate is increased to 19.9%. The total power required by the auxiliary compressor and the main compressor is 7145 KW. This is a savings of 725 KW, or 9.2%, as compared to the reduced recovery cycle.

The preferred embodiment, shown in the FIGURE, is to withdraw stream 122 at the same tray that the argon sidearm column 7 feed stream 109 is withdrawn. This will provide additional cost economies in the tray design of the low-pressure column 2. It is within the scope of the present invention to combine streams 110 and 128 before entry into the low-pressure column 2.

While one particular dual-column system is described above, the system is subject to numerous variations available to the person skilled in the art, depending upon the proposed application, without departing from the scope of the invention.

One such variation would be the deletion of the argon side arm column 7. Another variation would be to replace the dual-column system with a single-column system.

What is claimed is:

1. In a method for the production of ultra high purity oxygen by means of liquefying and fractionally distilling air in a dual-column air separation plant having a high-pressure column and a low-pressure column, the improvement for reducing the net energy requirement comprising the steps of:

removing an oxygen-rich vapor stream from a first intermediate level of the low-pressure column, compressing the vapor stream, condensing the compressed vapor stream to liquid in an auxiliary low-pressure column reboiler, flashing the condensed liquid stream to the pressure of the low-pressure column to form a stream of a gas and liquid mixture, returning the flashed stream to a second intermediate level of the low-pressure column.

2. The method of claim 1 wherein the compressed vapor stream is cooled in a heat exchanger before condensation.

3. The method of claim 1 wherein the second intermediate level is at the same tray or higher than the first intermediate level.

4. The method of claim 1 wherein crude argon is produced in addition to ultra high purity oxygen.

5. The method of claim 1 wherein the oxygen-rich vapor stream is removed at the same location that a feed to an argon sidearm column is withdrawn.

6. The method of claim 1 wherein the vapor stream is compressed to a pressure such that it will condense when in indirect heat exchange with boiling oxygen.

7. The method of claim 1 wherein the vapor stream is compressed to about 32 to 46 psia when in indirect heat exchange with boiling oxygen at about 20 to 27 psia.

8. In a method for the production of ultra high purity oxygen by means of liquefying and fractionally distilling air in a dual-column air separation plant having a high-pressure column and a low-pressure column, the improvement for reducing the net energy requirement comprising the steps of:

removing an oxygen-rich vapor stream from a first intermediate level of the low-pressure column, heating the vapor stream to ambient temperature, compressing the heated vapor stream followed by cooling in an after-cooler, cooling the compressed vapor stream by heat exchange against said vapor stream as it leaves the low-pressure column, condensing the cooled vapor stream to liquid in an auxiliary low-pressure column reboiler, flashing the condensed liquid stream to the pressure of the low-pressure column to form a stream of a gas and liquid mixture, returning the flashed stream to a second intermediate level of the low-pressure column.

9. The method of claim 8 wherein the second intermediate level is the same tray or higher than the first intermediate level.

10. The method of claim 8 wherein crude argon is produced in addition to ultra high purity oxygen.

11. The method of claim 10 wherein the oxygen-rich vapor stream is removed at the same location that a feed to an argon sidearm column is withdrawn.

12. The method of claim 8 wherein the vapor stream is compressed to a pressure such that it will condense when in indirect heat exchange with boiling oxygen.

13. The method of claim 12 wherein the vapor stream is compressed to about 32 to 46 psia when in indirect heat exchange with boiling oxygen at about 20 to 27 psia.

* * * * *